US008770694B2

(12) United States Patent
Umeda

(10) Patent No.: US 8,770,694 B2
(45) Date of Patent: Jul. 8, 2014

(54) PRINTING ELEMENT SUBSTRATE AND PRINTHEAD

(75) Inventor: Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/493,214

(22) Filed: Jun. 11, 2012

(65) Prior Publication Data

US 2013/0010021 A1 Jan. 10, 2013

(30) Foreign Application Priority Data

Jul. 4, 2011 (JP) ..... 2011-148621

(51) Int. Cl.

| | |
|---|---|
| ***B41J 29/38*** | (2006.01) |
| ***B41J 2/05*** | (2006.01) |
| ***B41J 2/045*** | (2006.01) |
| *B41J 2/14* | (2006.01) |

(52) U.S. Cl.

CPC ..... *B41J 2/0455* (2013.01); *B41J 2/0458* (2013.01); *B41J 2002/14491* (2013.01)

USPC ..... 347/12; 347/58

(58) Field of Classification Search

CPC . B41J 2/04506; B41J 2/04528; B41J 2/04541

USPC ..... 347/9–12, 20, 50, 57, 58

See application file for complete search history.

(56) References Cited

U.S. PATENT DOCUMENTS

| | | | | |
|---|---|---|---|---|
| 6,755,495 | B2 * | 6/2004 | Beck et al. | 347/12 |
| 7,114,791 | B2 * | 10/2006 | Umeda | 347/9 |
| 7,648,227 | B2 * | 1/2010 | Benjamin et al. | 347/58 |
| 7,850,262 | B2 | 12/2010 | Hirayama et al. | |
| 2001/0026292 | A1 | 10/2001 | Ishizaki | |
| 2002/0130912 | A1 | 9/2002 | Beck et al. | |
| 2005/0212857 | A1 | 9/2005 | Hirayama | |
| 2006/0170717 | A1 | 8/2006 | Kondoh | |
| 2009/0091594 | A1 | 4/2009 | Hirayama et al. | |

FOREIGN PATENT DOCUMENTS

| | | | |
|---|---|---|---|
| CN | 1717329 | A | 1/2006 |
| CN | 101203385 | A | 6/2008 |
| CN | 101600574 | A | 12/2009 |
| JP | 4245848 | B2 | 4/2009 |

OTHER PUBLICATIONS

European Communication issued in corresponding application No. 12004532.3 dated Oct. 12, 2012—4 pages.

Chinese Office Action issued in counterpart application No. 201210231149.1 dated Apr. 30, 2014, along with its English-language translation—16 pages.

* cited by examiner

*Primary Examiner* — An Do

(74) *Attorney, Agent, or Firm* — Fitzpatrick, Cella, Harper & Scinto

(57) ABSTRACT

A printing element substrate, including a printing element, a switching element which drives the printing element based on an input control signal, a first current source which generates a predetermined current, a second current source which generates a current based on an input voltage, and a current generation circuit which generates the control signal by amplifying a current obtained by adding a current generated by the second current source to a current generated by the first current source, and then generates the control signal by amplifying a current generated by the first current source.

9 Claims, 11 Drawing Sheets

50
VH
GNDH
Vref
HE
BLE1
BLE2
BLEn
LT
DATA
CLK
GROUP1
GROUP2
GROUPm
123
100-1
100-2
100-n
101-1
101-2
101-n
102
103
104
105-1
105-2
105-n
106-1
106-2
106-n
107
108
109
110-1
110-2
110-n
112-1
112-2
112-n
113-1
113-2
113-n
114
115
116
117
118
119
120
124-1
125
126-1
IH1
VD1
VG1
B
Ibias
Iout
Iboost
OUT
IN1
IN2
ΔV
LATCH CIRCUIT
SHIFT REGISTER
DECODER 50
VH
GNDH
Vref
HE
BLE1
BLE2
BLEn
LT
DATA
CLK
GROUPm
GROUP2
GROUP1
123
100-n
100-2
100-1
IH1
102
106-n
106-2
106-1
VD1
120
105-n
105-2
105-1
101-n
101-2
101-1
110-n
110-2
110-1
ΔV
103
112-n
112-2
112-1
113-n
113-2
113-1
117
115
114
116
LATCH CIRCUIT
SHIFT REGISTER
118
DECODER
104
119
108
107
Ibias
Iout
Iboost
OUT
IN1
IN2
EN
109

50
VH
GNDH
Vref
HE
BLE1
BLE2
BLEn
LT
DATA
CLK
GROUP1
GROUP2
GROUPm
123
100-1
100-2
100-n
101-1
101-2
101-n
102
103
104
105-1
105-2
105-n
106-1
106-2
106-n
107
108
109
110-1
110-2
110-n
112-1
112-2
112-n
113-1
113-2
113-n
114
115
116
117
118
119
120
121
122
IH1
VD1
Ibias
Iout
Iboost
OUT
IN1
IN2
EN
ΔV
DECODER
LATCH CIRCUIT
SHIFT REGISTER

PRINTING ELEMENT SUBSTRATE AND PRINTHEAD

BACKGROUND OF THE INVENTION

1. Field of the Invention

The present invention relates to a printing element substrate and printhead.

2. Description of the Related Art

There is known a printing apparatus which adopts an inkjet printing method. This printing apparatus prints an image on a printing medium by discharging ink from printing elements arrayed on a printhead. Japanese Patent No. 4245848 discloses a printhead in which a feedback-amplifier controls power to be applied to the printing element to be constant.

To increase the printing operation speed, for example, the period of time to drive the printing element needs to be shortened to 1 μs or less. During the period of the time for driving the printing element, the feedback-amplifier adjusts the impedance of the driving element while detecting the voltage of the printing element, thereby controlling power to be applied to the printing element to be constant (feedback control).

However, to quickly perform feedback control within 1 μs or less, a bias current Ibias to be supplied to the feedback-amplifier needs to be increased. Since the bias current Ibias of the feedback-amplifier is a steady current, simply increasing the bias current Ibias results in large power consumption. Large power consumption raises the printhead temperature, affecting the image quality.

SUMMARY OF THE INVENTION

The present invention provides a technique capable of quickly feedback-controlling a voltage to be applied to a printing element with low power consumption.

According to an aspect of the present invention, there is provided a printing element substrate, comprising a printing element, a switching element which drives the printing element based on an input control signal, a first current source which generates a predetermined current, a second current source which generates a current based on an input voltage, and a current generation circuit which generates the control signal by amplifying a current obtained by adding a current generated by the second current source to a current generated by the first current source, and then generates the control signal by amplifying a current generated by the first current source.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. However, the present invention is not limited to such a specific system. For example, an electrophotography system using toners as color material may be adopted.

The printing apparatus may be, for example, a single-function printer having only a printing function, or a multi-function printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" does not only mean forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Also, a "nozzle" generically means an orifice, a liquid channel which communicates with it, and an element which generates energy used for ink discharge, unless otherwise specified.

First Embodiment

Figure 1:
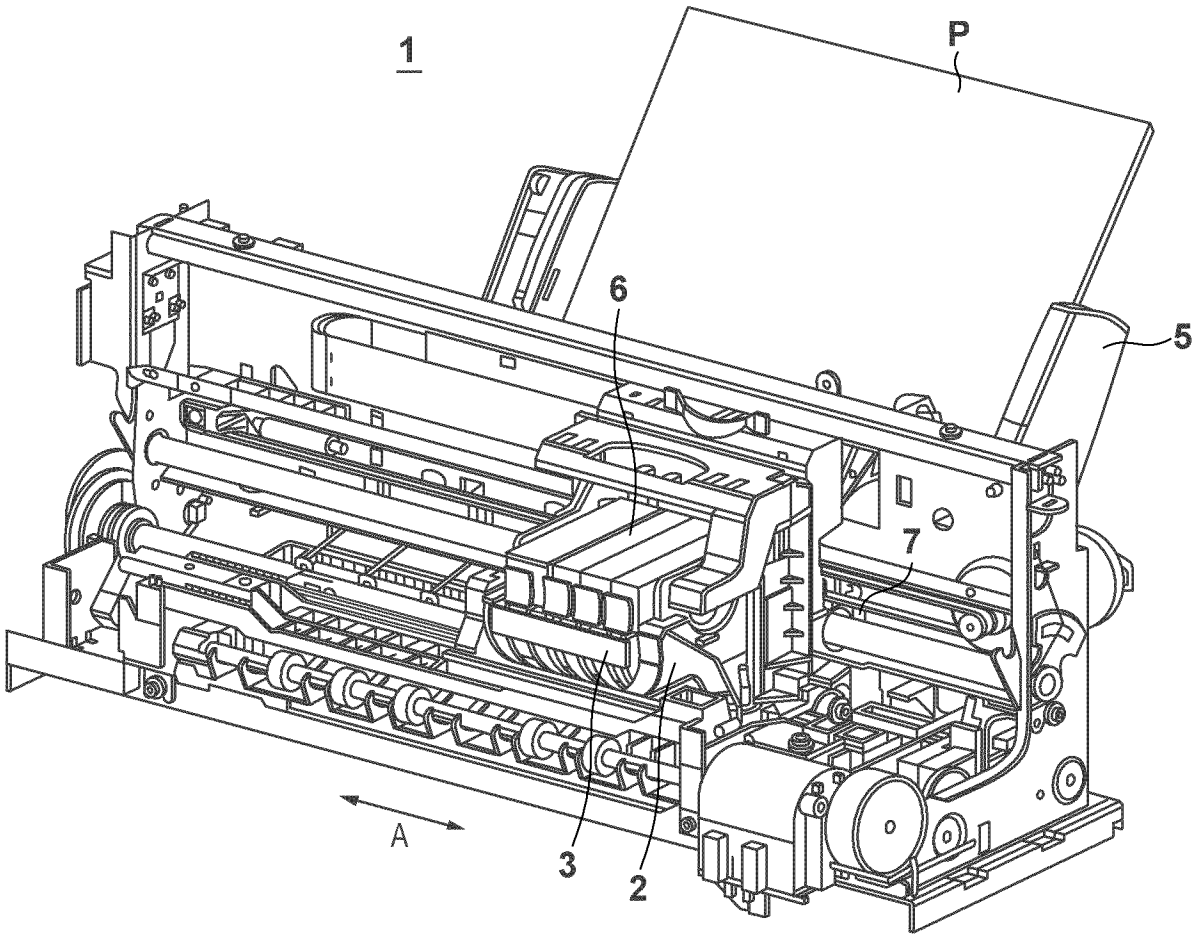
FIG. 1 is a perspective view showing an inkjet printing apparatus (to be referred to as a printing apparatus) 1 according to an embodiment of the present invention.

FIG. 1 is a perspective view showing an inkjet printing apparatus (to be referred to as a printing apparatus hereinafter) 1 according to an embodiment of the present invention.

The printing apparatus 1 prints by reciprocally moving, in directions (scanning directions) indicated by an arrow A, a carriage 2 which supports an inkjet printhead (to be referred to as a printhead hereinafter) 3 for discharging ink according to the inkjet method to print. The printing apparatus 1 supplies a printing medium P via a sheet supply mechanism 5, and conveys it to the printing position. At the printing position, the printhead 3 prints by discharging ink onto the printing medium P.

In addition to the printhead 3, for example, an ink cartridge 6 is mounted on the carriage 2 of the printing apparatus 1. The ink cartridge 6 stores ink to be supplied to the printhead 3. Note that the ink cartridge 6 is detachable from the carriage 2.

The printing apparatus 1 shown in FIG. 1 is capable of color printing. For this purpose, four ink cartridges which store, for example, magenta (M), cyan (C), yellow (Y), and black (K) inks, respectively are mounted on the carriage 2. These four ink cartridges are independently detachable.

The printhead 3 includes a printing element substrate (to be also simply referred to as a substrate hereinafter), and a plurality of nozzle arrays are arranged on the substrate. The printhead 3 employs, for example, the inkjet method of discharging ink using thermal energy. The printhead 3 includes printing elements each formed from a heat generation element (to be referred to as a heater hereinafter), and a control circuit which controls heater driving. Heaters are arranged in correspondence with respective nozzles (orifices), and a pulse voltage is applied to a corresponding heater in accordance with a printing signal.

A recovery device 4 is arranged outside the range of reciprocal motion of the carriage 2 (outside the printing area) to recover the printhead 3 from a discharge failure. The position where the recovery device 4 is arranged is a so-called home position. The printhead 3 stands still at this position while no printing operation is performed.

The arrangement of the printing apparatus 1 has been exemplified. Note that the arrangement of the printing apparatus 1 shown in FIG. 1 is merely an example, and is not always limited to this. For example, in the arrangement of FIG. 1, the printing medium P is conveyed to the printhead 3. However, the printhead 3 and printing medium P suffice to relatively move, and the arrangement is not particularly limited. For example, the printhead 3 may move with respect to the printing medium P.

Figure 2:
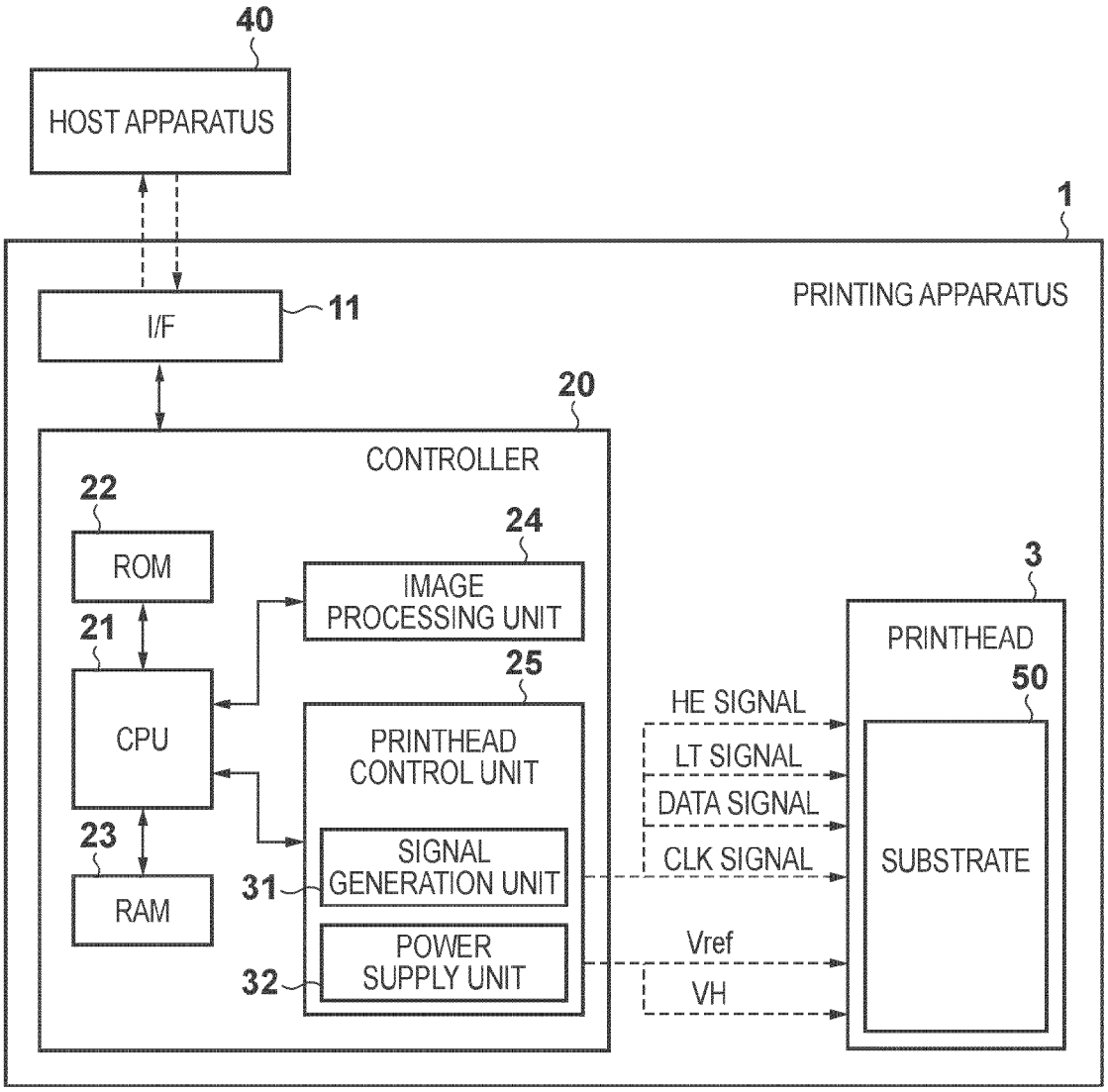
FIG. 2 is a block diagram exemplifying the functional arrangement of the printing apparatus 1 shown in FIG. 1.

FIG. 2 is a block diagram exemplifying the functional arrangement of the printing apparatus 1 shown in FIG. 1.

The printing apparatus 1 is connected to a host apparatus 40. The host apparatus 40 is implemented by a computer (or an image reader or digital camera) serving as an image data supply source. The host apparatus 40 and printing apparatus 1 exchange image data, commands, and the like via an interface (to be referred to as an I/F hereinafter) 11.

A controller 20 includes a CPU (Central Processing Unit) 21, ROM (Read Only Memory) 22, RAM (Random Access Memory) 23, image processing unit 24, and printhead control unit 25.

The CPU 21 executively controls processes in the controller 20. The ROM 22 stores programs and various data. The RAM 23 is used as a work area when executing a program by the CPU 21, and temporarily stores various calculation results and the like.

The image processing unit 24 performs various image processes for image data received from the host apparatus 40 via the I/F 11.

The printhead control unit 25 controls the printhead 3. The printhead control unit 25 includes a signal generation unit 31 and power supply unit 32.

The signal generation unit 31 generates various signals, and transfers the generated signals to the printhead 3. The signals transferred to the printhead 3 are, for example, a serial clock CLK, serial data DATA, latch signal LT, and heat enable signal HE.

The power supply unit 32 supplies, to the printhead 3, power necessary to drive it. For example, the power supply unit 32 supplies a driving voltage VH, reference voltage Vref, and the like to the printhead 3.

Based on a signal transferred from the printhead control unit 25, the printhead 3 discharges ink from each orifice in the printhead 3. The printhead 3 includes a printing element substrate 50 on which a plurality of printing elements are arranged, which will be described in detail.

Figure 3:
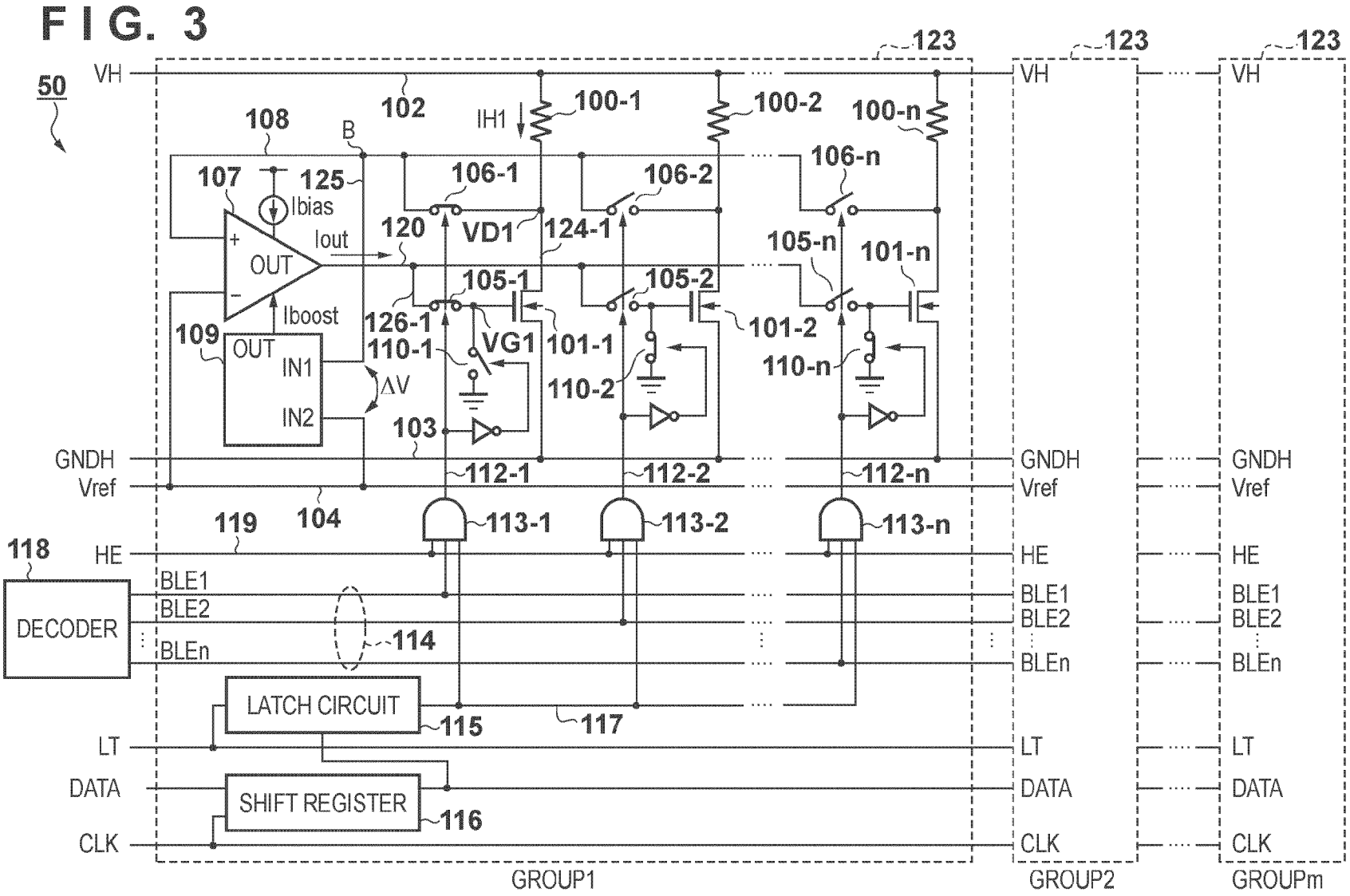
FIG. 3 is a circuit diagram exemplifying the circuit arrangement of a printing element substrate 50.

The circuit arrangement of the printing element substrate 50 shown in FIG. 2 will be exemplified with reference to FIG. 3.

The printing element substrate 50 includes groups in correspondence with printing elements 100. Each group includes the printing elements 100, driving elements (switching elements) 101, first switches 106, second switches 110, third switches 105, and printing element selecting circuits 113. In addition, a driving ground line 103, a feedback-amplifier 107, a voltage-current converter 109, the printing element selecting circuits 113, a latch circuit 115, a shift register 116, and the like are arranged on the printing element substrate 50. The printing elements 100 and driving elements 101 are connected by driving lines 124, respectively. For example, the printing element 100-1 and driving element 101-1 are connected by the driving line 124-1. The driving ground line 103 is connected to the ground of the power supply unit 32.

A plurality of printing elements 100, that is, 100-1, 100-2, . . . , **100-*n* are arranged. A current is supplied to apply a voltage for a predetermined period to only printing elements which are to perform the printing operation out of these printing elements. Each printing element 100 has the first terminal connected to a driving voltage VH 102, and the second terminal connected to the first switch 106 and driving element (switching element) 101**.

The first switch 106, second switch 110, third switch 105, and printing element selecting circuit 113 select, from a plurality of printing elements, a printing element which is to perform the printing operation.

The printing element selecting circuit 113 outputs a driving signal 112 based on the logical product of a printing data signal 117 held in the latch circuit 115, a block selection signal 114 output from a decoder 118, and a heat enable signal 119. The driving signal is a signal for designating driving of a corresponding printing element.

The printing data signal 117 and block selection signal 114 define a printing element which is to perform the printing operation. The heat enable signal 119 defines the period of time for driving the printing element. More specifically, the printing element is drivable while the heat enable signal 119 is at high level, and driving of the printing element is inhibited while it is at low level.

When the driving signal 112 changes to high level, the third switch 105 and first switch 106 are turned on, and the second switch 110 is turned off. The second terminal of a selected printing element is connected to a feedback line 108, and the gate of the driving element 101 corresponding to the selected printing element is connected to a control line 120. For example, a discharge line 126-1 for connection to ground is interposed between the gate of the driving element 101-1 and the third switch 105-1. The second switch 110-1 is inserted in the discharge line 126-1.

When the driving signal 112 changes to low level, the third switch 105 and first switch 106 are turned off, and the second switch 110 is turned on. Thus, the feedback line 108 and control line 120 open. Since the second switch 110 is ON, a voltage applied to the driving element 101 is grounded. Hence, gate voltages VG1 of the driving elements 101-1 become equal to voltage of ground (voltage of the ground line 103).

The driving element 101 is formed from a semiconductor element having a control gate (control terminal), for example, an n-type MOS transistor (FET transistor). The driving element 101 supplies a current (that is, energizes) to the printing element 100. The driving element 101 is turned on/off based on a signal input to the control gate, and has a drain connected to the second terminal of the printing element and a source connected to the ground line 103.

The feedback-amplifier 107 uses, for example, a differential amplifier which consumes a steady bias current Ibias. The feedback-amplifier 107 has the first input terminal which receives a reference voltage Vref 104, the second input terminal which receives a voltage (feedback voltage) via the feedback line 108, and an output terminal which outputs a signal based on the inputs.

The feedback-amplifier (amplifier) 107 controls the impedance of the driving element 101 by adjusting the voltage of the control gate of the driving element 101. More specifically, the feedback-amplifier 107 equalizes the reference voltage Vref 104 and the voltage of the second terminal of the printing element connected to the feedback line 108.

The voltage-current converter 109 functions as a current generation means (current generation unit). More specifically, the voltage-current converter 109 generates a current Iboost corresponding to a potential difference ΔV between the reference voltage 104 and a voltage input from the feedback line 108, and supplies the current Iboost to the feedback-amplifier 107. The voltage of the second terminal of the printing element is input to an input IN1 of the voltage-current converter 109 via a feedback line 125 branched at point B from the feedback line 108. More specifically, the voltage-current converter 109 receives the reference voltage 104 and a current output to the branch of the second terminal (connection portion) of the printing element, and outputs, to the feedback-amplifier 107, the current Iboost amplified in accordance with them.

Figure 4:
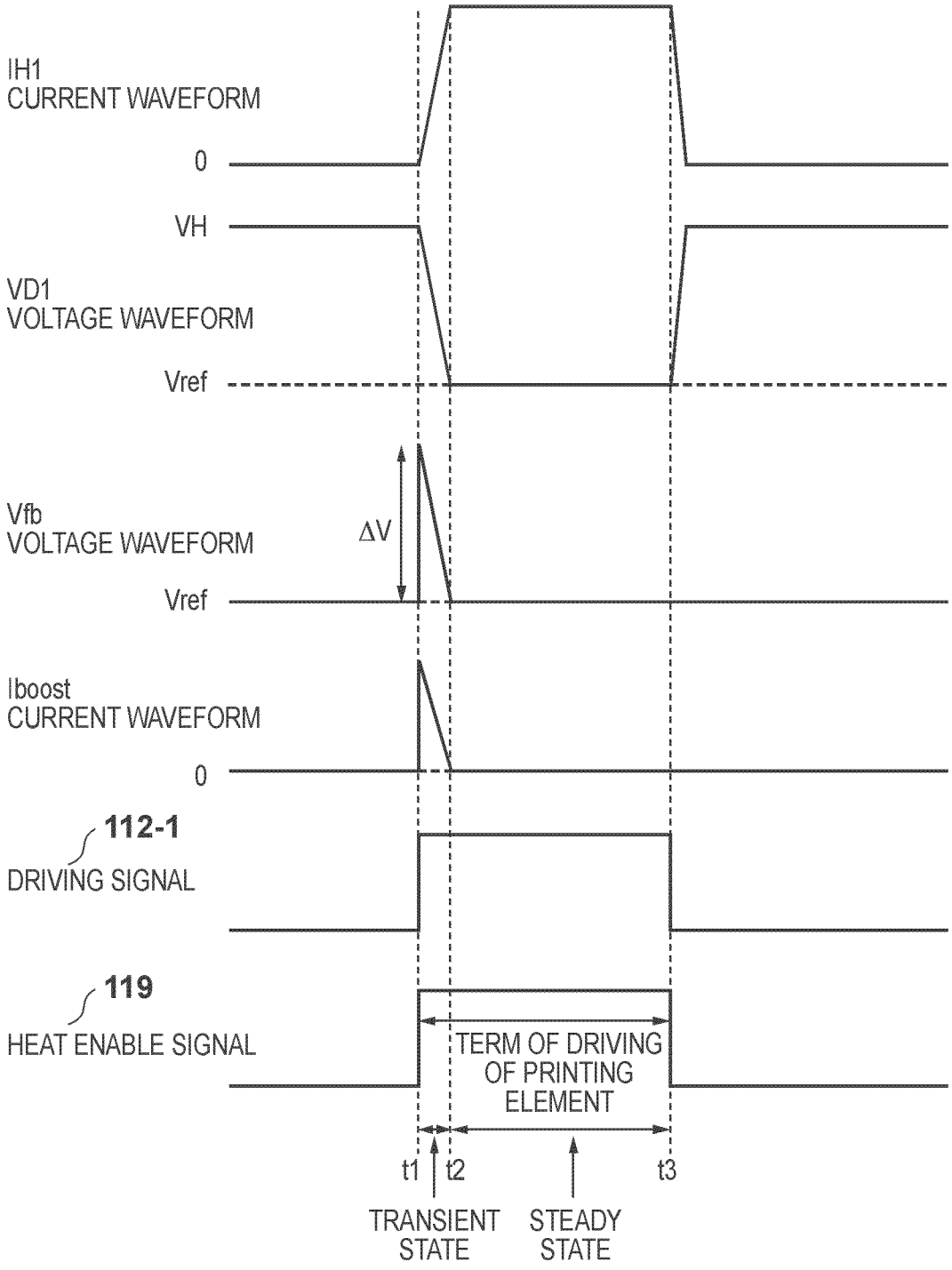
FIG. 4 is a timing chart exemplifying the driving timing of the printing element substrate 50.

The driving timing of the printing element substrate 50 shown in FIG. 3 will be exemplified with reference to FIG. 4.

FIG. 4 shows the waveforms of a current IH1 flowing through the printing element 100-1, a voltage VD1 of the second terminal of the printing element 100-1, a voltage Vfb of the feedback line 108, and the current Iboost generated by the voltage-current converter 109. FIG. 4 also shows the waveforms of the driving signal 112-1 and heat enable signal 119. A case in which only the printing element 100-1 shown in FIG. 3 is selected to perform the printing operation will be exemplified.

When the driving signal 112-1 changes to high level at time t1, the third switch 105-1 and first switch 106-1 are turned on, and the second switch 110-1 is turned off. Then, the second terminal of the printing element 100-1 is connected to the feedback line 108, and the gate of the driving element 101-1 is connected to the control line 120.

The feedback-amplifier 107 outputs a current Iout, and gradually raises the voltage of the gate of the driving element 101-1. In response to this, a current starts flowing through the printing element 100-1 and driving element 101-1 (that is, conduct them), and the voltage VD1 of the second terminal gradually drops from the driving voltage VH to the reference voltage Vref 104. At time t2, the voltage VD1 becomes equal to the reference voltage Vref 104.

In a transient state from time t1 to time t2, the voltage-current converter 109 generates the current Iboost corresponding to the potential difference ΔV between the voltage VD1 of the second terminal of the printing element 100-1 and the reference voltage 104, and supplies Iboost to the feedback-amplifier 107.

The maximum value of the current Iout output from the feedback-amplifier 107 becomes the sum of the bias current Ibias of the feedback-amplifier 107 and the current Iboost generated by the voltage-current converter 109. The current Iout can quickly charge the gate of the driving element 101-1. The voltage VD1 of the second terminal of the printing element 100-1 can quickly reach the target reference voltage Vref, minimizing the time of the transient state from time t1 to time t2.

In a steady state from time t2 to time t3, the feedback-amplifier 107 equalizes the voltage VD1 of the second terminal of the printing element 100-1, that is, the voltage of the feedback line 108 to the reference voltage Vref. Hence, the current Iboost generated by the voltage-current converter 109 becomes zero, and supply of a current from the voltage-current converter 109 to the feedback-amplifier 107 stops.

When the driving signal 112-1 changes to low level at time t3, the third switch 105-1 and first switch 106-1 are turned off, and the second switch 110-1 is turned on. In response to this, the gate of the driving element 101-1 is connected to the ground line 103. The driving element 101-1 is disconnected, stopping currents flowing through the printing element 100-1 and driving element 101-1. The voltage VD1 of the second terminal of the printing element 100-1 rises from the reference voltage Vref to the driving voltage VH.

By this operation, in the period (from time t1 to time t3) in which the driving signal is at high level, the voltage VD1 of the second terminal of the printing element is quickly controlled from the driving voltage VH to the reference voltage Vref. This makes power applied to the printing element constant.

As described above, to increase the printing operation speed, for example, the period of time for driving the printing element needs to be shortened to 1 μs or less. When the period of time for driving of the printing element is short, if the transient state from time t1 to time t2 is long, the leading edge of a current flowing through the printing element becomes blunt, greatly decreasing a voltage to be applied to the printing element.

In the embodiment, to prevent this, the voltage-current converter 109 is arranged to increase the current Iout output from the feedback-amplifier 107 only in the transient state from time t1 to time t2. In the steady state (from time t2 to time t3) in which the voltage of the feedback line 108 is equal to the reference voltage Vref, the current Iboost becomes zero, and current consumption is only Ibias. This operation can quickly feedback-control a voltage to be applied to the printing element with low power consumption.

Figure 5:
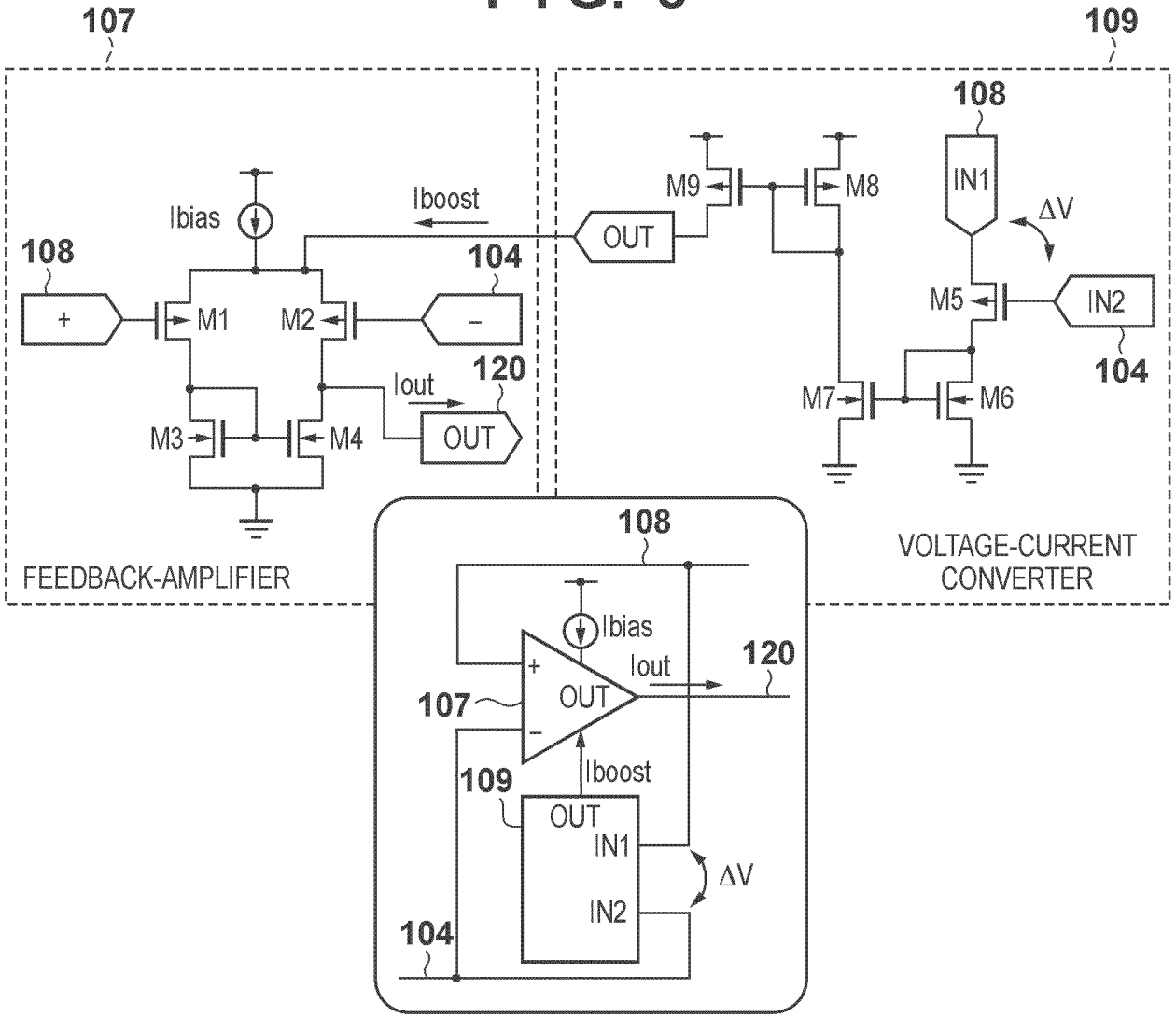
FIG. 5 is a circuit diagram exemplifying the circuit arrangement of a feedback-amplifier 107 and voltage-current converter 109.

The circuit arrangement of the feedback-amplifier 107 and voltage-current converter 109 will be exemplified with reference to FIG. 5.

The feedback-amplifier 107 is formed from transistors M1 to M4, and the voltage-current converter 109 is formed from transistors M5 to M9.

In the voltage-current converter 109, the feedback line 108 is connected to the source of the transistor M5, and the reference voltage 104 is connected to its gate. When the voltage of the feedback line 108 becomes higher than the reference voltage 104 (potential difference ΔV is generated), a current flows through the transistor M5. This current is copied by a current mirror circuit made up of the transistors M6 to M9, supplying Iboost to the feedback-amplifier.

Hence, the maximum value of the output current Iout of the feedback-amplifier 107 becomes the sum of the bias current Ibias of the feedback-amplifier and Iboost. The output current Iout can quickly charge the gate of the driving element 101 connected to the driving line 120.

Figure 10:
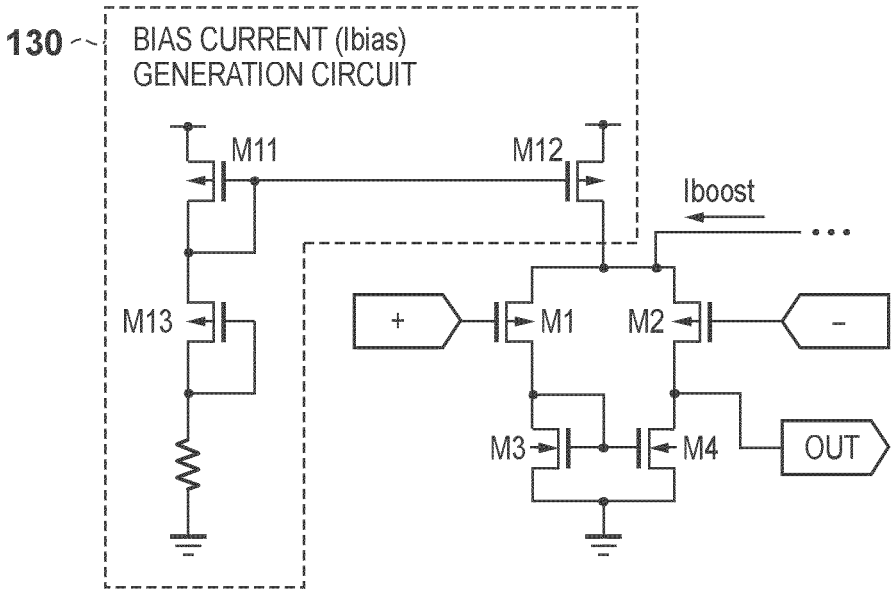
FIG. 10 is a circuit diagram exemplifying a bias current generation circuit.

When the voltage of the feedback line 108 is equal to the reference voltage 104, the transistor M5 is disconnected, and a current flowing through the transistor M5 and the current Iboost to be supplied to the feedback-amplifier 107 become zero. A consumed current is only Ibias. In other words, the circuit arrangement of the feedback-amplifier 107 and voltage-current converter 109 includes the first current source (Ibias) which generates a predetermined current, the second current source 109 which generates a current based on the input voltage (ΔV), and a current generation circuit which generates the control signal 120 by amplifying a current obtained by adding a current generated by the second current source to a current generated by the first current source, and then generates the control signal 120 by amplifying a current generated by the first current source. FIG. 10 is a circuit diagram exemplifying a bias current generation circuit 130 which generates the bias current Ibias. The bias current generation circuit 130 is formed from transistors M11 to M13.

Figure 11:
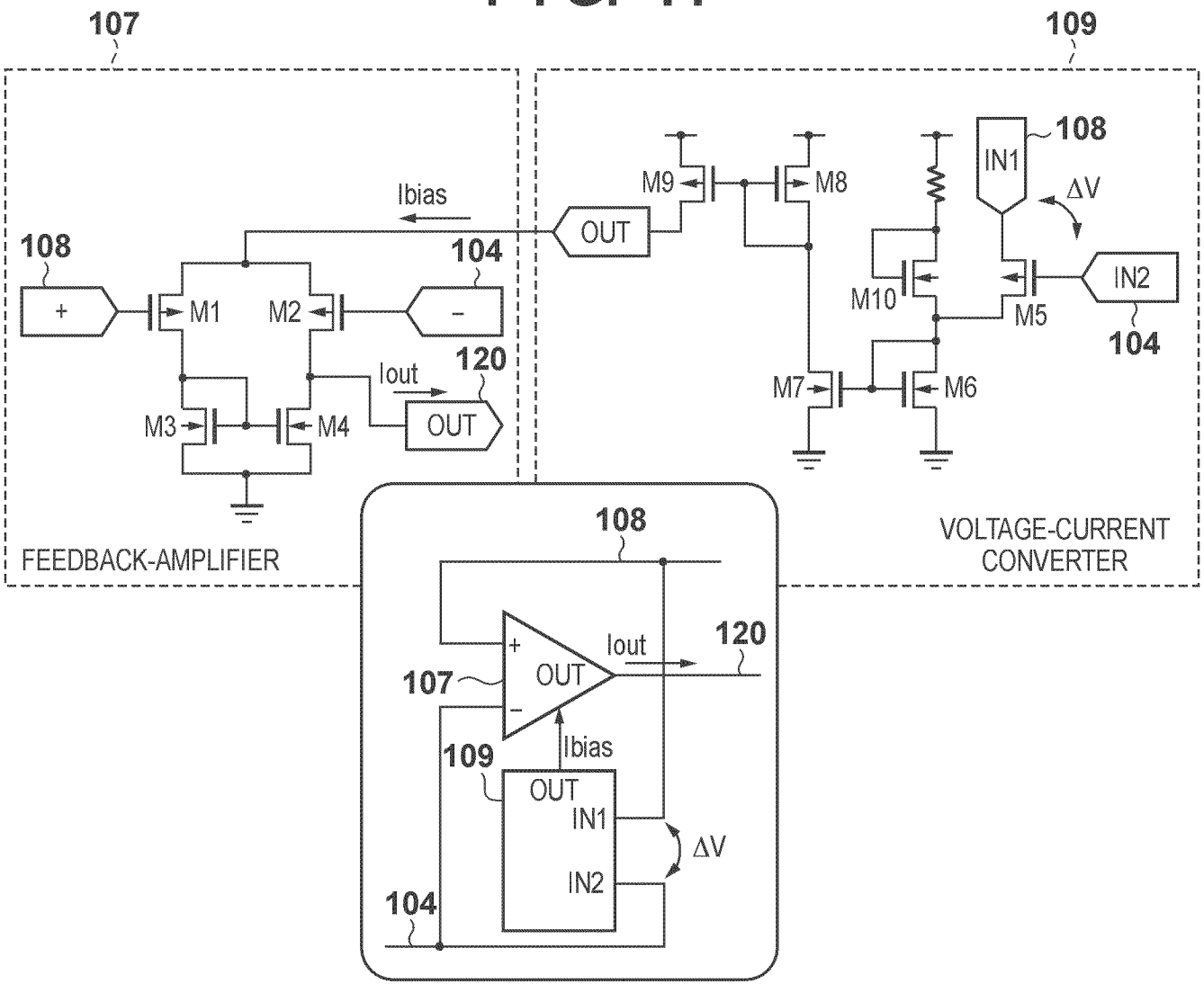
FIG. 11 is a circuit diagram showing another circuit arrangement of the feedback-amplifier 107 and voltage-current converter 109.

FIG. 11 shows another circuit arrangement of the feedback-amplifier 107 and voltage-current converter 109. The voltage-current converter 109 shown in FIG. 11 includes a transistor M10 for generating a predetermined bias current, and a transistor M5 for generating a current based on the potential difference ΔV.

As described above, in the embodiment, the voltage-current converter 109 is arranged and supplies the current Iboost to the feedback-amplifier 107 only in the transient state. Accordingly, a voltage to be applied to the printing element can be quickly feedback-controlled with low power consumption.

Second Embodiment

Figure 6:
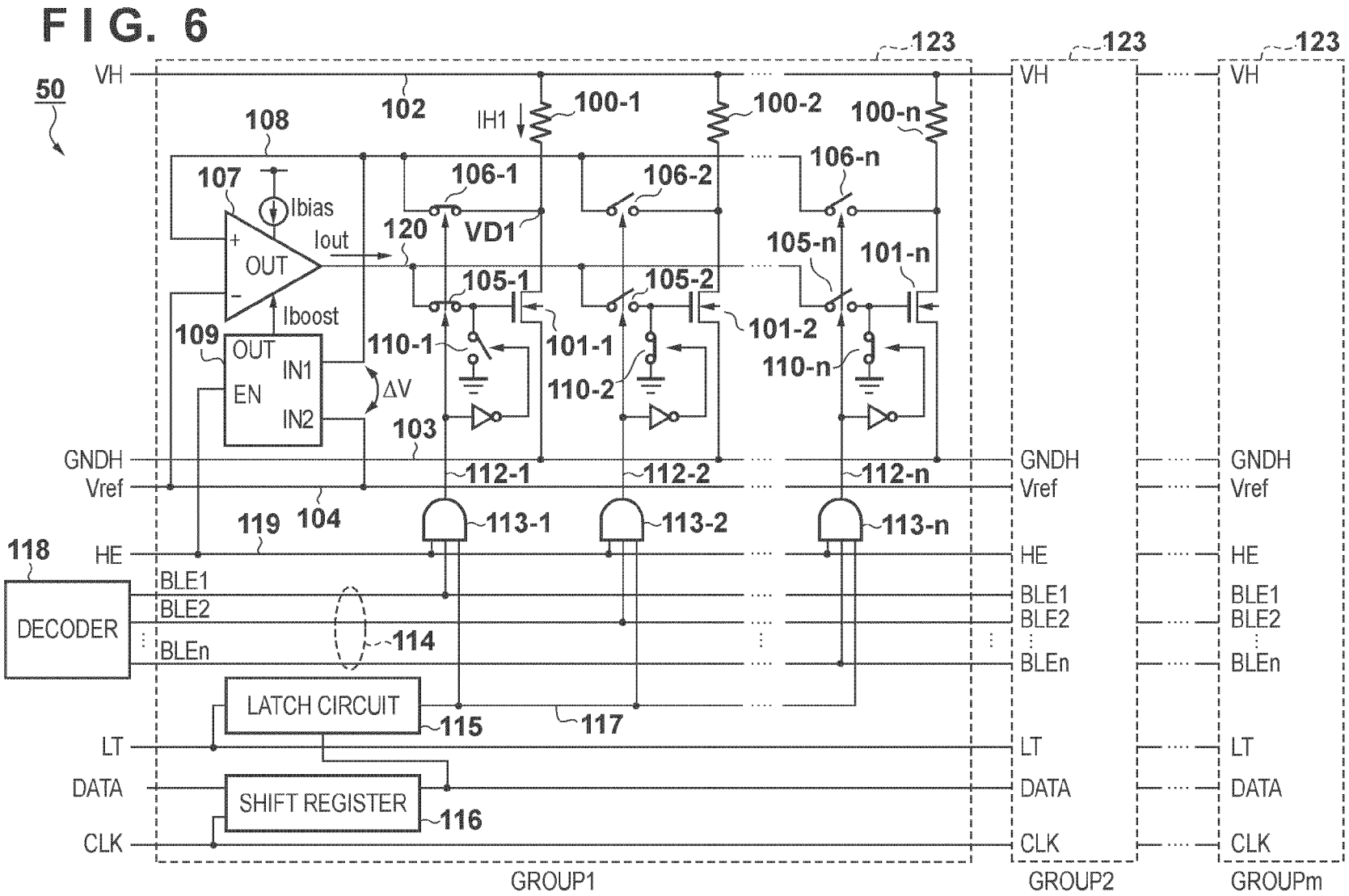
FIG. 6 is a circuit diagram exemplifying the circuit arrangement of a printing element substrate 50 according to the second embodiment.

The second embodiment will be described. FIG. 6 exemplifies the circuit arrangement of a printing element substrate 50 according to the second embodiment. A difference from FIG. 3 in the first embodiment is that a voltage-current converter 109 has an enable terminal EN.

In the second embodiment, the enable terminal EN switches whether to activate or inactivate the voltage-current converter 109. A signal input to the enable terminal EN is the heat enable signal HE. When the heat enable signal HE changes to high level, the voltage-current converter 109 is activated. The voltage-current converter 109 generates the current Iboost corresponding to the potential difference ΔV between a reference voltage 104 and a feedback line 108, and supplies the current Iboost to a feedback-amplifier 107. When the heat enable signal HE changes to low level, the voltage-current converter 109 is inactivated to completely stop the operation.

In this way, in addition to the arrangement according to the first embodiment, the second embodiment provides the function of completely stopping the operation of the voltage-current converter 109 during the period (before time t1 or after time t3 in FIG. 4) in which the heat enable signal is at low level.

While the heat enable signal is at low level, all first switches 106-1 to **106-*n* are turned off, and the feedback line 108 opens, making the voltage Vfb of the feedback line 108 unstable. If the voltage-current converter 109** remains active, it may generate an unexpected current Iboost.

In the second embodiment, to prevent this, the voltage-current converter 109 has the enable terminal. While the voltage Vfb of the feedback line 108 is unstable, the operation of the voltage-current converter 109 completely stops to prevent generation of the unexpected current Iboost.

Figure 7:
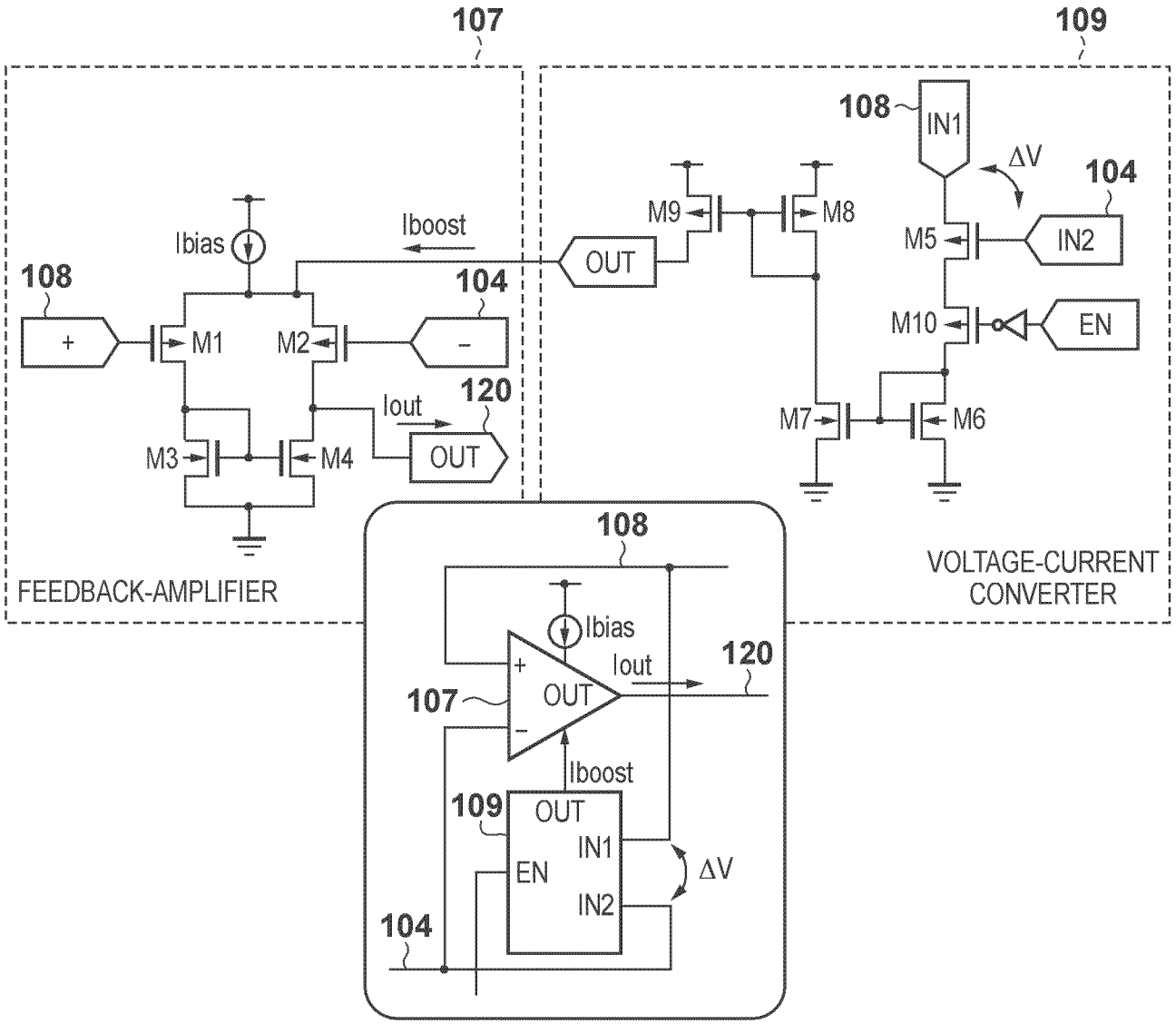
FIG. 7 is a circuit diagram exemplifying the circuit arrangement of a feedback-amplifier 107 and voltage-current converter 109 according to the second embodiment.

The circuit arrangement of the feedback-amplifier 107 and voltage-current converter 109 according to the second embodiment will be exemplified with reference to FIG. 7.

In the second embodiment, a transistor M10 is arranged in addition to the arrangement according to the first embodiment. The gate of the transistor M10 receives the inverted signal of the heat enable signal HE.

When the heat enable signal HE changes to high level, the transistor M10 is turned on, and a current corresponding to the potential difference ΔV flows through the transistor M5. This current is copied by a current mirror circuit made up of transistors M6 to M9, supplying Iboost to the feedback-amplifier.

When the heat enable signal HE changes to low level, the transistor M10 is turned off. Even if the potential difference ΔV exists, no current flows through the transistor M5, the transistors M6 to M9 are disconnected, and Iboost becomes completely zero.

As described above, according to the second embodiment, activation/inactivation (ON/OFF) of the voltage-current converter 109 is switched in synchronism with the heat enable signal HE. This can prevent generation of the unexpected current Iboost.

Third Embodiment

Figure 8:
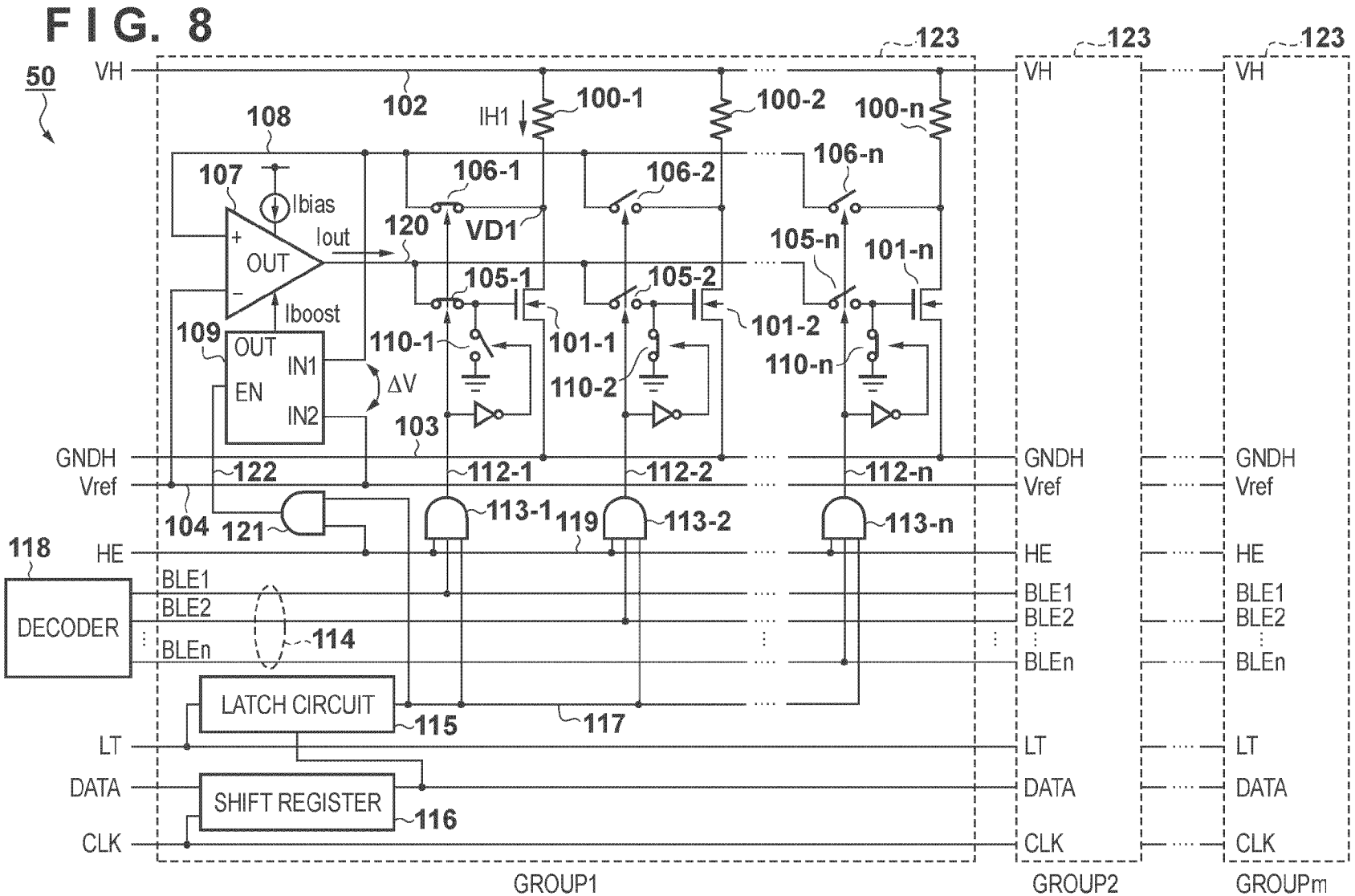
FIG. 8 is a circuit diagram exemplifying the circuit arrangement of a printing element substrate 50 according to the third embodiment.

The third embodiment will be described. FIG. 8 exemplifies the circuit arrangement of a printing element substrate 50 according to the third embodiment. A difference from FIG. 6 in the second embodiment is that a signal input to the enable terminal EN of a voltage-current converter 109 is a voltage-current conversion enable signal 122.

The voltage-current conversion enable signal 122 is the logical product of the heat enable signal HE and a printing data signal 117, and is generated by a voltage-current conversion enable signal generation circuit 121.

When the voltage-current conversion enable signal 122 changes to high level, the voltage-current converter 109 is activated, generates the current Iboost corresponding to the potential difference ΔV between a reference voltage 104 and a feedback line 108, and supplies the current Iboost to a feedback-amplifier 107. When the voltage-current conversion enable signal 122 changes to low level, the voltage-current converter 109 is inactivated to completely stop the operation.

In addition to the arrangement according to the second embodiment, the third embodiment adds the function of completely stopping the operation of the voltage-current converter 109 when the printing data signal 117 is at low level. As described above, while the heat enable signal HE is at low level, the feedback line 108 is open. In addition, when the printing data signal changes to low level, all first switches 106-1 to **106-*n* are turned off, and the feedback line 108 also opens, making the voltage Vfb of the feedback line 108 unstable. If the voltage-current converter 109** remains active, it may generate an unexpected current Iboost.

In the third embodiment, to prevent this, the voltage-current conversion enable signal 122 serving as the logical product of the printing data signal 117 and heat enable signal HE is generated. Based on this signal, activation/inactivation of the voltage-current converter 109 is switched.

By calculating the logical product of the printing data signal 117 and heat enable signal HE, a state in which the feedback line 108 is open can be completely detected, completely preventing generation of the unexpected current Iboost.

Figure 9A:
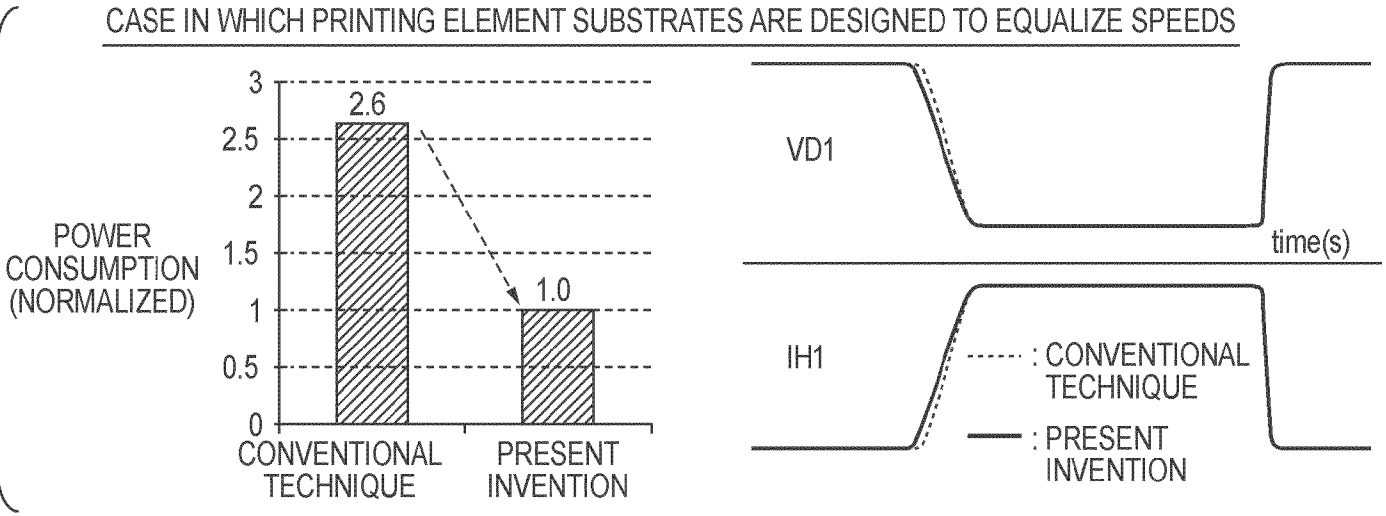
FIGS. 9A and 9B are views for explaining effects in comparison with a conventional technique.
Figure 9B:
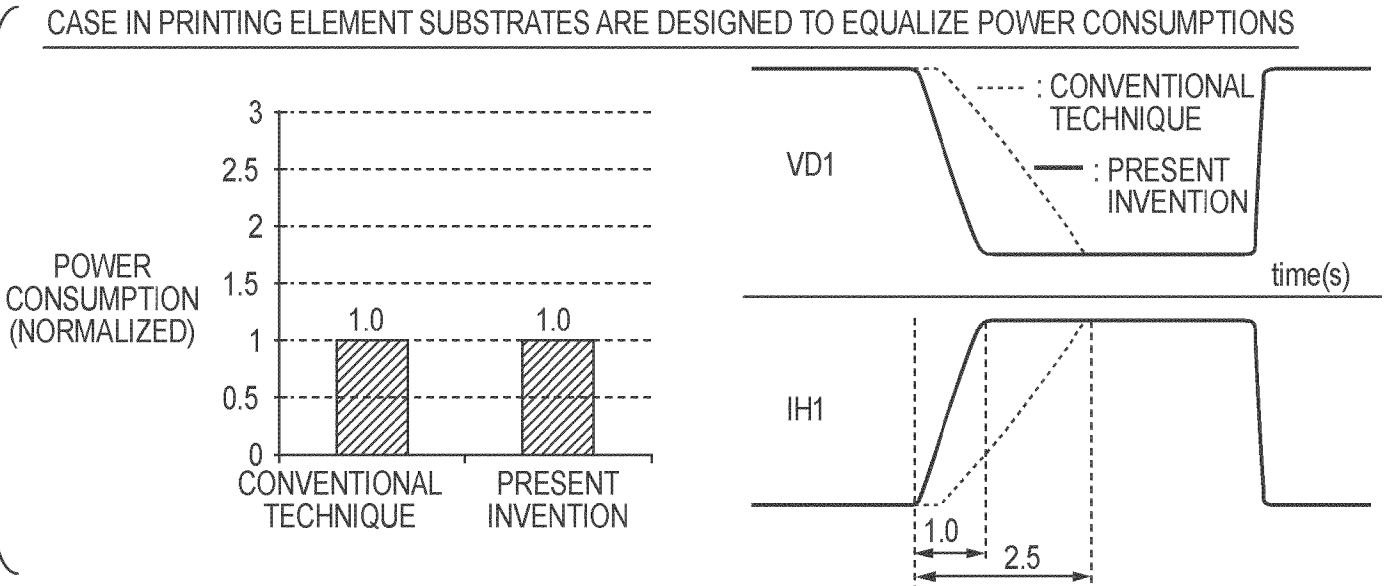

The effects of the above-described first to third embodiments will be explained with reference to FIGS. 9A and 9B in comparison with a conventional technique. FIGS. 9A and 9B show the waveform of the current IH1 flowing through the printing element substrate, that of the voltage VD1 of the second terminal of the printing element substrate, and the simulation result of power consumption of the printing element substrate in the first to third embodiments and the conventional technique.

FIG. 9A shows the simulation results of printing element substrates designed to equalize the driving speeds of printing elements in the first to third embodiments and the conventional technique. As shown in FIG. 9A, applying one of the first to third embodiments can reduce power consumption to $1/2.6$, compared to the conventional technique.

FIG. 9B shows the simulation results of printing element substrates set to equalize power consumptions in the first to third embodiments and the conventional technique. As shown in FIG. 9B, applying one of the first to third embodiments can reduce the time of the transient state to $1/2.5$, compared to the conventional technique even if power consumptions are equal. This reveals that the first to third embodiments can greatly increase the driving speed of the printing element.

By executing processing described in the first to third embodiments, a voltage to be applied to the printing element can be quickly feedback-controlled with low power consumption.

Typical embodiments of the present invention have been exemplified. However, the present invention is not limited to the embodiments described above with reference to the accompanying drawings, and can be properly modified without departing from the scope of the invention.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable storage medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-148621 filed on Jul. 4, 2011, which is hereby incorporated by reference herein in its entirety.

What is claimed is:

1. A printing element substrate comprising:
- a printing element;
- a switching element which drives said printing element based on an input control signal;
- a first current source which generates a predetermined current;
- a second current source which generates a current based on an input voltage;
- a current generation circuit which generates the control signal by amplifying a current obtained by adding a current generated by said second current source to a current generated by said first current source, and then generates the control signal by amplifying a current generated by said first current source;
- a first signal line which supplies a current from said printing element to said switching element;
- a second signal line which supplies a reference voltage;
- a third signal line which supplies the voltage of said first signal line to said second current source; and
- a first switch which is inserted in said third signal line and switches said third signal line between connection and disconnection based on a driving signal for designating driving of said printing element,
- wherein said first switch is controlled to a connected state when the driving signal for designating driving of said printing element is active and a disconnected state when the driving signal for designating driving of said printing element is inactive.

2. The substrate according to claim 1, wherein said switching element includes a transistor including an input which receives the control signal.

3. The substrate according to claim 1, wherein said current generation circuit amplifies a current based on the input voltage.

4. The substrate according to claim 1, further comprising:
- a plurality of printing elements; and
- a plurality of switching elements which are arranged in correspondence with said respective printing elements,
- wherein said current generation circuit supplies the control signal to said plurality of switching elements.

5. The substrate according to claim 1, wherein said current generation circuit receives an instruction signal for designating switching of an operation between activation and inactivation.

6. The substrate according to claim 5, wherein the instruction signal includes a heat enable signal which defines a period of time for driving said printing element.

7. The substrate according to claim 5, wherein the instruction signal includes a signal generated based on a logical product of a data signal which defines a printing element that is to perform a printing operation, and a heat enable signal which defines a period of time for driving said printing element.

8. A printhead comprising a printing element substrate defined in claim 1.

9. A printing element substrate comprising:
- a printing element;
- a switching element, including a transistor including an input which receives an input control signal, which drives said printing element based on the control signal;

a first current source which generates a predetermined current;

a second current source which generates a current based on an input voltage;

a current generation circuit which generates the control signal by amplifying a current obtained by adding a current generated by said second current source to a current generated by said first current source, and then generates the control signal by amplifying a current generated by said first current source;

a fourth signal line which connects the input and ground; and a second switch which switches said fourth signal line between connection and disconnection based on a driving signal for designating driving of said printing element, wherein said second switch is controlled to a connected state when the driving signal for designating driving of said printing element is inactiveand a disconnected state when the driving signal for designating driving of said printing element is active.

* * * * *